US005739505A

United States Patent [19]

Hasegawa et al.

[11] Patent Number: 5,739,505

[45] Date of Patent: Apr. 14, 1998

[54] TEMPERATURE CONTROL METHOD AND APPARATUS FOR AN ELECTRIC FURNACE

[75] Inventors: Tamotsu Hasegawa, Nagoya; Norihiro Amano, Toyota; Katsuhito Yamada, Nagoya; Masuji Oshima, Kariya, all of Japan

[73] Assignee: Toyota Jidosha Kabushiki Kaisha, Toyota, Japan

[21] Appl. No.: 752,392

[22] Filed: Nov. 20, 1996

[30] Foreign Application Priority Data

Nov. 21, 1995 [JP] Japan ..... 7-302658

[51] Int. Cl.[6] ..... H05B 1/02

[52] U.S. Cl. ..... 219/494; 219/497; 219/425; 219/505; 373/154; 373/148

[58] Field of Search ..... 219/494, 497, 219/499, 501, 505, 506, 492, 425; 373/147, 148, 154, 156, 138, 165, 136

[56] References Cited

U.S. PATENT DOCUMENTS 4,133,969 1/1979 Zumbrunnen ..... 13/23
4,603,730 8/1986 Davis et al. ..... 165/30

FOREIGN PATENT DOCUMENTS 56-132790 10/1981 Japan .
4-179090 6/1992 Japan .

*Primary Examiner*—Mark H. Paschall
*Attorney, Agent, or Firm*—Cushman Darby & Cushman IP Group of Pillsbury Madison & Sutro LLP

[57] ABSTRACT

In an electric furnace including a heating device which includes a cooling water passage for cooling the heating device to prevent the heating device from melting, estimation of a molten metal temperature in the electric furnace using a heat equilibrium model is conducted taking into account a thermal loss by the cooling water, i.e., the amount of a heat taken away by the cooling water. Further, the amount of the cooling water flowing through the heating device is adjusted so that the thermal loss by the cooling water is in a predetermined optimum thermal loss range.

9 Claims, 4 Drawing Sheets

TEMPERATURE CONTROL METHOD AND APPARATUS FOR AN ELECTRIC FURNACE

This application is based on application no. HEI 7-302658 filed in Japan on Nov. 21, 1995, the content of which is incorporated hereinto by reference.

BACKGROUND OF THE INVENTION

1. Field of the Invention

The present invention relates to a temperature control method and apparatus for an electric furnace.

2. Description of Related Art

With an electric furnace, control of a molten metal temperature is important to secure a good quality product. However, it is difficult to measure continuously the molten metal temperature in real time. Therefore, as disclosed in Japanese Patent Publication No. HEI 4-179090, conventionally, a temperature control method has been employed to firstly measure a molten metal temperature at only one time and after the measurement, a change of the molten metal temperature is estimated using a thermal equilibrium model to thereby control the molten metal temperature.

However, in the conventional molten metal temperature estimation method using a thermal equilibrium model, heat taken away by coil cooling water is not taken into account in the heat balance. Therefore, by not accounting for the heat taken away by the coil cooling water an error will result, decreasing an accuracy of the temperature estimation.

SUMMARY OF THE INVENTION

An object of the present invention is to provide a temperature control method and apparatus for an electric furnace using a heat equilibrium model wherein an accuracy of temperature estimation is increased and a temperature of a molten metal can be controlled with a high accuracy.

According to the present invention, the above-described object can be achieved by the following method and apparatus.

(1) A temperature control method is provided for an electric furnace, the electric furnace including a heating device, the heating device including a cooling water passage formed therein causing cooling water to flow therethrough for preventing the heating device from melting. The method includes the steps of: determining a thermal loss which occurs due to the cooling water passing through the water passage; and estimating a molten metal temperature by taking the determined thermal loss into account in a molten metal temperature estimation model, and controlling the molten metal temperature based on the estimation model.

(2) A method according to (1) further includes, between the thermal loss determining step and the molten metal temperature estimating step, a step of controlling at least one of a flow amount and a temperature of the cooling water so that a thermal loss determined at the thermal loss determining step is in an optimum thermal loss range predetermined for various operating conditions of the furnace.

(3) A temperature control apparatus for an electric furnace, the electric furnace including a heating device, the heating device including a cooling water passage formed therein constructed and arranged to permit cooling water to flow therethrough for preventing the heating device from melting, the apparatus includes: a detecting device for detecting data necessary for determining a thermal loss which occurs due to the cooling water passing through the water passage; a molten metal temperature estimation device for estimating a molten metal temperature, having a molten metal temperature estimation model where a thermal loss determined using the data detected by the detecting device is taken into account; and a molten metal temperature control device for controlling electric power supplied to the heating device so that a molten metal temperature estimated by the molten metal temperature estimation device is controlled to a predetermined temperature.

(4) An apparatus according to (3) further includes: an adjusting device for adjusting at least one of a flow amount and a temperature of the cooling water; and a control device for controlling the adjusting device so that a thermal loss by the cooling water determined based on data detected by the detecting device is in an optimum thermal loss range predetermined for various operating conditions of the furnace.

In the method of (1) and apparatus of (3), because the molten metal temperature is estimated taking into account the amount of a heat taken away by the cooling water in the model, the estimation accuracy is increased, so that a molten metal temperature control with a high accuracy is possible.

In the method of (2) and apparatus of (4), because the flow amount or the temperature of the cooling water is adjusted, the heat taken away by the cooling water can be controlled to be in the predetermined thermal loss range, so that the thermal loss by the cooling water during operation of the furnace is minimized.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
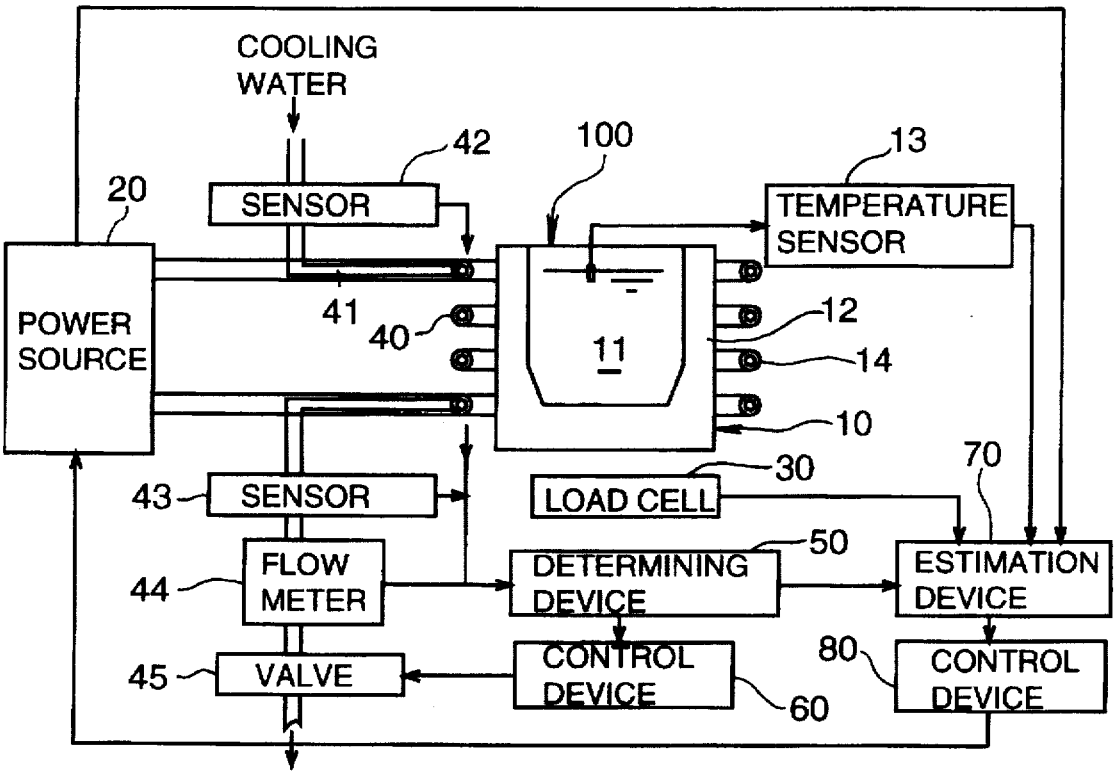
FIG. 1 is a system diagram of a temperature control apparatus of an electric furnace according to an embodiment of the present invention.
Figure 2:
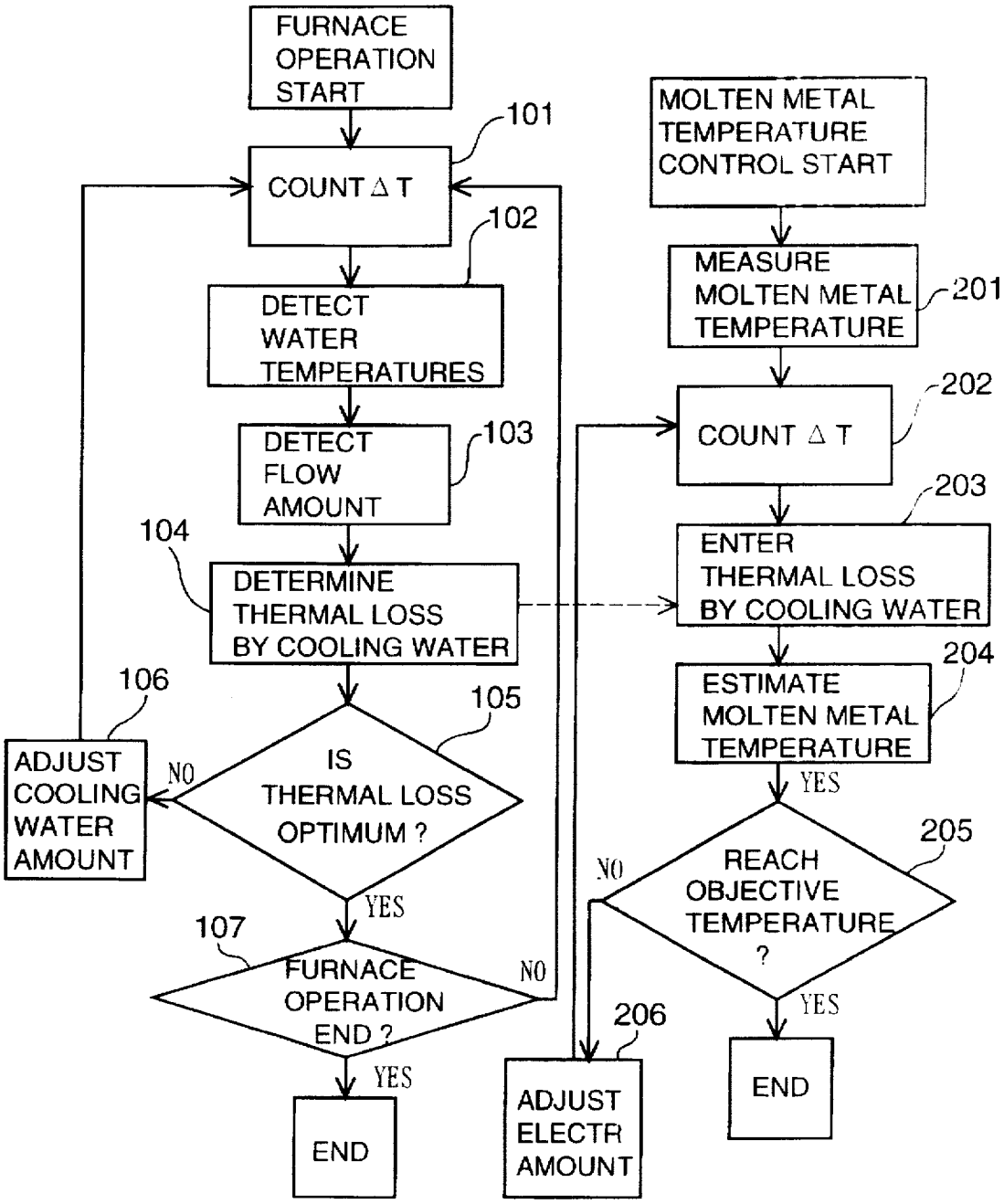
FIG. 2 is a flow chart of a temperature control method for an electric furnace according to an embodiment of the present invention.

FIG. 1 illustrates a temperature control apparatus 100 for an electric furnace according to an embodiment of the present invention, and FIG. 2 illustrates a temperature control method thereof.

First, the apparatus will be explained with reference to FIG. 1. The temperature control apparatus 100 for an electric furnace includes an electric furnace, (for example, an induction furnace) generally indicated at 10, having a heating device 14 and a crucible 12 for holding a molten metal 11, an electric power source 20 for supplying an electric power for heating the furnace to the heating device, and a load cell 30 for measuring a weight of the molten metal 11. The heating device 14 includes a heating coil (an induction coil) 40 or a heating electrode and has a cooling water passage 41 formed therein permitting cooling water to flow therethrough for cooling the heating device 14 to thereby prevent the heating device from melting.

The temperature control apparatus 100 for an electric furnace further includes a detecting device for detecting data necessary to determine a thermal loss by cooling water (the amount of a heat taken away by the cooling water) and a thermal loss determining device 50 for determining a thermal loss by the cooling water (i.e., the amount of a heat taken away by the cooling water) based on the data detected by the detecting device. The detecting device includes an inlet cooling water temperature detecting sensor 42 disposed in the cooing water passage 41 on an inlet side of the heating device 14, an outlet cooling water temperature detecting sensor 43 disposed in the cooling water passage 41 on an outlet side of the heating device 14, and a flow meter 44 disposed in the cooling water passage 41 for measuring the amount of the cooling water flowing in the cooling water passage 41. The thermal loss determining device 50 is connected to the sensors 42 and 43 and the flow meter 44, and calculates a thermal loss which occurs due to the cooling water (i.e., the amount of a heat taken away by the cooling water) based on the temperatures measured by the sensors 42 and 43 and the flow amount measured by the flow meter 44.

The temperature control apparatus 100 for an electric furnace further includes an adjusting device for adjusting at least one of a flow amount and a temperature of the cooling water, and a control device for controlling the adjusting device so that a thermal loss which occurs due to the cooling water determined by the thermal loss determining device 50 is in an optimum thermal loss range predetermined for various operating conditions of the furnace. The adjusting device includes, for example, a flow control valve 45 disposed in the cooling water passage 41. The control device includes, for example, a flow control device 60 which issues a control instruction to the adjusting device 45 based on the determined thermal loss.

Adjustment of the flow amount based on the thermal loss by the cooling water may be substituted by adjustment of the cooling water inlet temperature by, for example, a heat exchanger.

The temperature control apparatus 100 for an electric furnace further includes (a) a molten metal temperature sensor 13 for measuring a temperature of a molten metal in the crucible 12 which may or may not contact the molten metal, (b) a molten metal temperature estimation device 70 for estimating a molten metal temperature and its change using a molten metal temperature estimation model based on the molten metal temperature measured by the molten metal temperature sensor 13, the thermal loss by the cooling water determined by the thermal loss determining device 50, and the electric power supplied to the heating device, and (c) a molten metal temperature control device 80 for controlling electric power supplied to the heating device so that the molten metal temperature estimated by the molten metal temperature estimation device 70 is controlled to a predetermined temperature.

Next, a temperature control method for an electric furnace according to an embodiment of the present invention conducted using the above-described apparatus will be explained.

The temperature control method for an electric furnace includes the steps of determining a thermal loss which occurs due to the cooling water (steps 101 to 104 in FIG. 2), and estimating a molten metal temperature using the heat equilibrium model and taking into account the thermal loss determined at the thermal loss determining step in the model and thereby controlling the molten metal temperature (steps 201 to 206 in FIG. 2).

The temperature control method for an electric furnace further includes a step of controlling at least one of a flow amount and a temperature of the cooling water so that the thermal loss determined at the thermal loss determining steps is in an optimum thermal loss range predetermined for various operating conditions of the electric furnace (steps 105 and 106 in FIG. 2).

More particularly, the routine of FIG. 2 is entered at every interval of time period ΔT, counted at step 101, after start of operation of the furnace. At step 102, an inlet cooling water temperature and an outlet cooling water temperature are detected by the inlet water temperature sensor 42 and the outlet water temperature sensor 43, respectively, and the outputs thereof are fed to the thermal loss determining device 50. At step 103, a flow amount of the cooling water is detected and the output thereof is fed to the thermal loss determining device 50. Steps 102 and 103 may be conducted in any order.

Then, at step 104, a thermal loss which occurs due to the cooling water (the amount of a heat taken away by the cooling water) is determined (or calculated) using equation (1) shown below, which is stored in the thermal loss determining device 50, at every interval of time period ΔT.

$$dQ_w(t)=C_w\cdot G_w\cdot F_w(t)\cdot(T_{ow}(t)-T_{iw}(t))[W] \quad (1)$$

where, $C_w$: a specific heat of the cooling water pre-stored in the device [W·hr/kg·°C.]

$G_w$: a specific weight of the cooling water pre-stored in the device [kg/m$^3$]

$F_w(t)$: a flow amount of the cooling water measured by the flow meter 44 [m$^3$/hr]

$T_{iw}(t)$: a cooling water temperature measured by the sensor 42 [°C.]

$T_{ow}(t)$: a cooling water temperature measured by the sensor 43 [°C.]

The thermal loss by the cooling water $dQ_w(t)$ is monitored at every interval of time period ΔT, and the flow amount of the cooling water is controlled by the flow control device 60 and the flow control valve 45 so that the thermal loss by the cooling water $dQ_w(t)$ is controlled to be in a predetermined optimum thermal loss range in accordance with the operating conditions of the furnace (at step 106).

Figure 3:
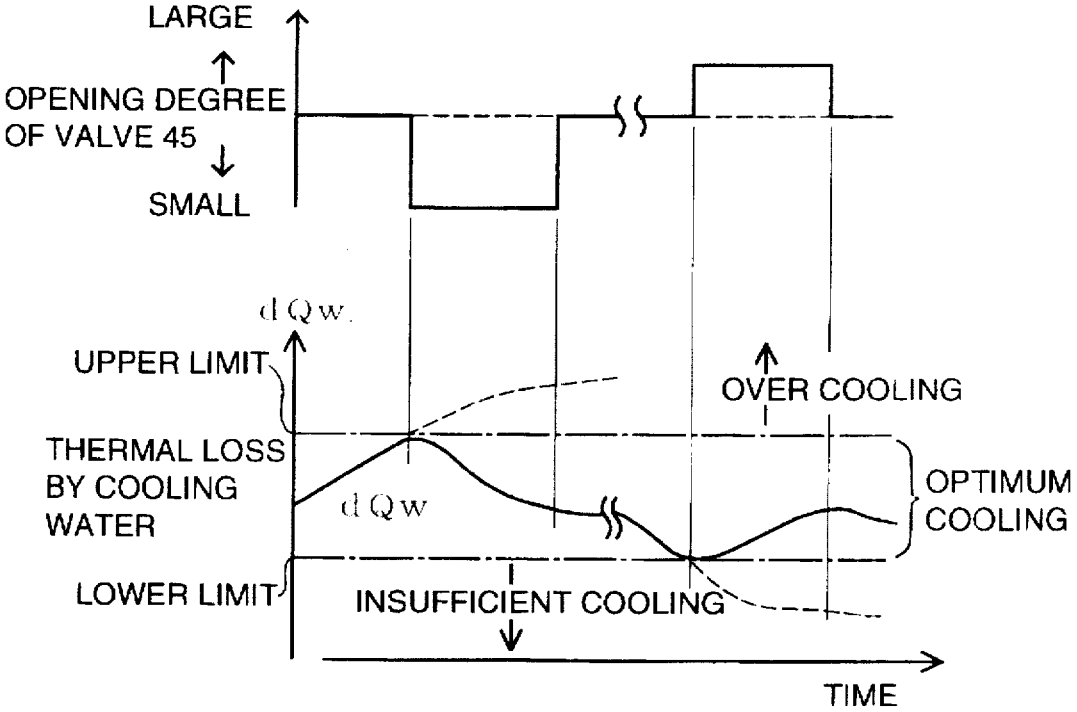
FIG. 3 is a graph illustrating a controlled state of thermal loss by cooling water.

In this regard, the optimum thermal loss range (AR) means a range where the heating coil 40 is cooled so as not to rise abnormally in temperature. The range (AR) has an upper limit (UL) and a lower limit (LL). As illustrated in FIG. 3, if the value of $dQ_w(t)$ exceeds the upper limit UL, the condition is in an over cooling state, where the degree of opening of the flow control valve 45 should be decreased so that an unnecessary increase in the cooling water amount may be prevented. On the contrary, if the value of $dQ_w(t)$ changes to be lower than the lower limit LL, the condition is in an insufficient cooling state, where the degree of opening of the flow control valve 45 should be increased so that an over heat of the coil may be prevented.

Preferably, a decrease or increase in the amount of the opening degree of the flow control valve 45 may be proportional to a deviation of the instant opening degree from the upper or lower limit of the optimum thermal loss range so that a proportional feed back control is conducted.

On the other hand, a molten metal temperature $T_O$ is measured at only one time using the molten metal temperature sensor 13 at step 21. The temperature $T_0$ is fed to the heat equilibrium model having equation (2) stored in the molten metal temperature estimation device 70 as an initial temperature of the molten metal temperature. Then, at every interval of time period ΔT which is counted at step 202, a molten metal temperature and its change is estimated at step 204, taking into account the thermal loss by the cooling water fed, the data of which are fed from step 104 at step 203.

$$C_m \cdot W_m(t) \cdot (dT_m(t)/dt) = P(t) - dQ_w(t) - dQ_m(t) [W] \quad (2)$$

where, $C_m$: a specific heat of the molten metal [W·hr/kg·°C.]

$W_m(t)$: a weight of the molten metal measured by the load cell 30 [kg]

$dT_m(t)$: an estimated temperature of the molten metal, the initial value of which is $T_0$ at t=0[°C.]

P(t): an electric power supplied to the coil 40 from the electric power source 20 [W]

$dQ_w(t)$: the amount of the thermal loss determined at equation (1) [W]

$dQ_m(t)$: a heat dissipation amount determined from the following equation (3) [W]

$$dQ_m(t) = K(T_m(t) - T_a(t)) \quad (3)$$

where,

K: an overall heat transfer coefficient predetermined by test [W/°C.]

$T_a(t)$: an atmospheric temperature[°C.]

Then, the molten metal temperature is controlled to a predetermined temperature by generating an instruction signal at the molten metal control device 80 using a PDI (proportion, differentiation, integration) algorithm based on a differential between the predetermined objective temperature and the estimated temperature $T_m(t)$, and then feeding the instruction signal to the electric power source 20 (steps 205 and 206).

Figure 4:
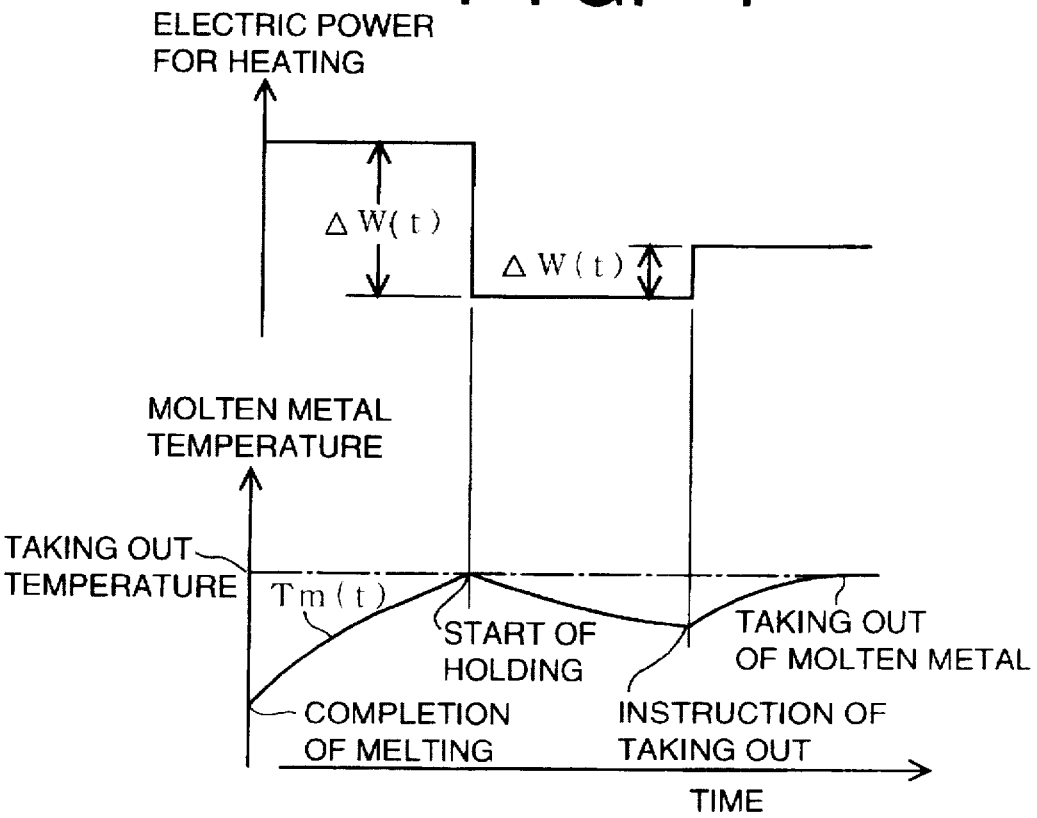
FIG. 4 is a graph illustrating a controlled state of a molten metal temperature.

In this regard, for the predetermined objective temperature of the molten metal, for example, a molten metal temperature is taken at the time of taking out the molten metal from the furnace. A feed back control signal directed to the electric power source is a signal of a change amount in the electric power ΔW(t), which is determined by the following equation (4).

$$\Delta W(t) = KP \cdot (T_m(t-1) - T_m(t)) + KI \cdot \Delta T(t) + KD \cdot (2 \cdot T_m(t-1) - T_m(t-2) - T_m(t)) \quad (4)$$

where, $T_m(t-1)$ and $T_m(t-2)$ are temperatures at a time period ΔT and a time period 2ΔT, respectively. FIG. 4 illustrates one example of a result between the molten metal temperature at the time of taking out the molten metal from the furnace and the electric power for heating, controlled according to this type of temperature control.

Figure 5:
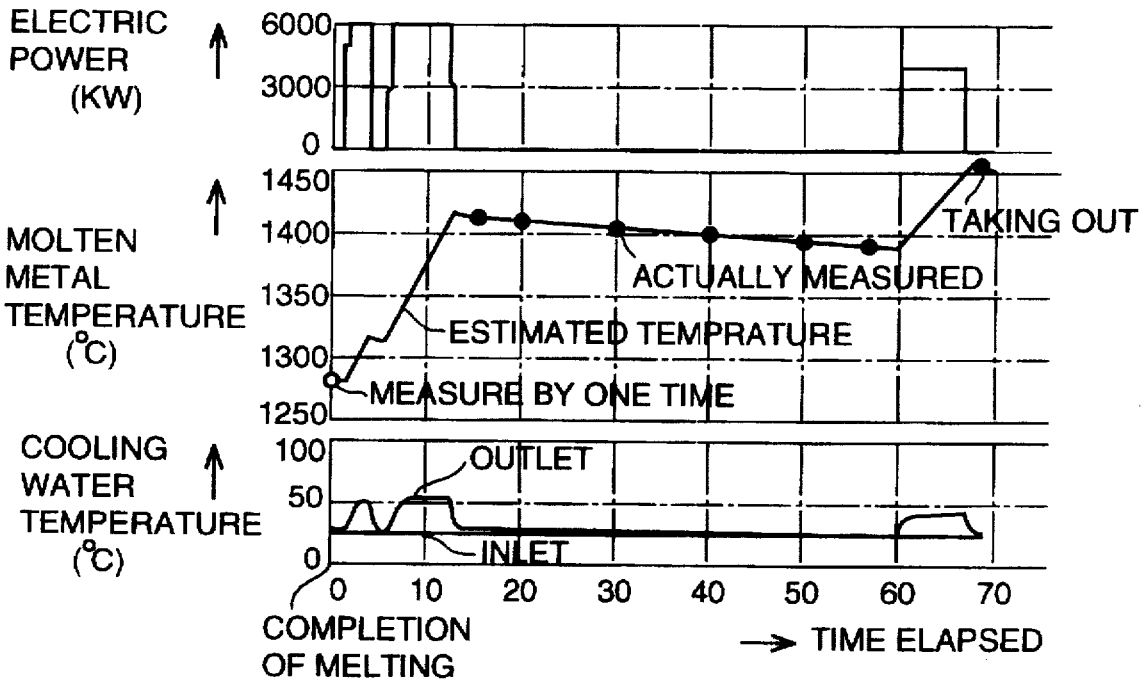
FIG. 5 is a graph illustrating a controlled state of a molten metal temperature in a case of a 20 ton induction furnace.

FIG. 5 illustrates a relationship between the molten metal temperature and the cooling water temperature and supplied power, the control of which was conducted using the temperature control method according to the present invention. As seen from FIG. 5, the estimated molten metal temperature shown by the full line and the actually measured molten metal temperature shown by the black circle points coincide with each other with a high accuracy. This means that the molten metal temperature control according to the present invention has a high accuracy.

Further, because the cooling water amount is adjusted so that the thermal loss by the cooling water is in the optimum thermal loss range predetermined over various operating conditions of the electric furnace, the thermal loss by the cooling water during operation of the furnace is minimized. As a result, an unnecessary increase in the thermal loss of the furnace is prevented.

According to the present invention, the following technical advantages are obtained.

In the method and apparatus according to the present invention, because the thermal loss by the cooling water is taken into account in estimation of the molten metal temperature, the estimation accuracy is increased. As a result, controlling the molten metal temperature with a high accuracy, a decrease in a time period needed to heat and melt the metal, and prevention of over heating of the furnace are possible.

Further, because the amount and/or temperature of the cooling water is adjusted so that the thermal loss by the cooling water is in the optimum thermal loss range, the thermal loss of the furnace is minimized.

Although the present invention has been described with reference to specific exemplary embodiments, it will be appreciated by those skilled in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. A method for controlling temperature in an electric furnace, the electric furnace including a heating device, the heating device including a cooling water passage formed therein permitting cooling water to flow therethrough for preventing the heating device from melting, said method comprising the steps of:

passing cooling water through the water passage;

determining a thermal loss which occurs due to said cooling water;

estimating a temperature of molten metal in the furnace by taking said determined thermal loss into account in a molten metal temperature estimation model; and controlling said molten metal temperature based on the estimation model.

2. A method according to claim 1 further comprising, between said thermal loss determining step and said temperature estimating step, a step of:

controlling at least one of a flow amount and a temperature of said cooling water so that a thermal loss determined at said thermal loss determining step is in an optimum thermal loss range, said range being predetermined for various operating conditions of said furnace.

3. A temperature control apparatus for an electric furnace, the electric furnace including a heating device, the heating device including a cooling water passage formed therein permitting cooling water to flow therethrough for preventing the heating device from melting, said apparatus comprising:

a detecting device operatively associated with the water passage for detecting data necessary for determining a thermal loss which occurs due to the cooling water passing through the water passage;

a molten metal temperature estimation device constructed and arranged to estimate a temperature of the molten metal in the furnace, said estimation device having a molten metal temperature estimation model and being operatively associated with said detecting device such that a thermal loss determined from data detected by said detecting device is taken into account in the model; and a molten metal temperature control device constructed and arranged to control electric power supplied to the heating device so that a temperature estimated by said molten metal temperature estimation device is controlled to a predetermined temperature.

4. An apparatus according to claim 3, in combination with said heating device, wherein said heating device is one of a heating coil and a heating electrode.

5. An apparatus according to claim 3, wherein said detecting device includes:

an inlet cooling water temperature detecting sensor disposed in said cooling water passage on an inlet side of said heating device;

an outlet cooling water temperature detecting sensor disposed in said cooling water passage on an outlet side of said heating device; and a flow meter disposed in said cooling water passage for measuring a cooling water flow amount.

6. An apparatus according to claim 3, further comprising:

a thermal loss determining device operatively associated with said detecting device and constructed and arrange to determine an amount of a heat taken away by said cooling water based on data detected by said detecting device, and a molten metal temperature measuring sensor constructed and arranged to measure a temperature of molten metal in the furnace, and wherein said molten metal temperature estimating device is operatively associated with said molten metal temperature measuring sensor and estimates a molten metal temperature based on (1) a temperature measured by said molten metal temperature measuring sensor, (2) an amount of a heat taken away by said cooling water determined by said thermal loss determining device, and (3) electric power supplied to said heating device.

7. An apparatus according to claim 6, further comprising:

an adjusting device for adjusting at least one of a flow amount and a temperature of said cooling water; and a control device operatively associated with said adjusting device and constructed and arranged to control said adjusting device so that a thermal loss which occurs due to said cooling water determined based on data detected by the detecting device, is in an optimum thermal loss range predetermined for various operating conditions of said furnace.

8. An apparatus according to claim 7, wherein adjusting device includes a flow control valve disposed in said cooling water passage.

9. An apparatus according to claim 7, wherein control device includes a flow control device which issues a control signal to said adjusting device based on said determined thermal loss.

* * * * *